United States Patent [19]

Rogers

[11] 4,148,345

[45] Apr. 10, 1979

[54] PRODUCTION OF WOODWOOL

[76] Inventor: Bernard T. Rogers, Braes, Ullapool, Ross-shire, Scotland

[21] Appl. No.: 807,301

[22] Filed: Jun. 16, 1977

[30] Foreign Application Priority Data

Jun. 24, 1976 [GB] United Kingdom ..... 7667/75

[51] Int. Cl.[2] ..... B27C 1/12; B37L 11/04

[52] U.S. Cl. ..... 144/185; 144/42; 144/162 R; 144/326 D

[58] Field of Search ..... 241/277, 279, 280; 144/41–44, 162 R, 172, 174, 176, 218, 230, 326 A, 326 B, 326 C, 326 D, 185

[56] References Cited

U.S. PATENT DOCUMENTS

| | | | |
|---|---|---|---|
| 2,349,034 | 5/1944 | Elmendorf | 144/326 D |
| 2,655,189 | 10/1953 | Clark | 144/326 C |
| 2,712,842 | 7/1955 | Fahrni | 144/326 C |
| 2,739,627 | 3/1956 | Vohringer | 144/326 D |
| 2,876,811 | 3/1959 | Matthews | 144/326 C |
| 3,017,912 | 1/1962 | Sybertz et al. | 144/326 A |
| 3,025,895 | 3/1962 | Girard | 144/326 C |

FOREIGN PATENT DOCUMENTS

| | | | |
|---|---|---|---|
| 1048012 | 12/1958 | Fed. Rep. of Germany | 144/172 |
| 2213618 | 10/1973 | Fed. Rep. of Germany | 144/172 |

*Primary Examiner*—Othell M. Simpson
*Assistant Examiner*—W. D. Bray
*Attorney, Agent, or Firm*—Ostrolenk, Faber, Gerb & Soffen

[57] ABSTRACT

A woodwool producing machine comprises a cutter wheel which is supported with its axis vertical and which has a frusto-conical rim at its outer periphery. The rim tapers upwardly and has a circumferential array of slots formed in it, a cutter assembly, which comprises a pair of cutters for cutting woodwool strands from timber stock, is mounted in each slot. Several timber feed magazines are positioned at spaced intervals around the circumference of the rim and are adapted to support and locate pieces of timber stock against the outer surface of the rim with their grain generally tangential to the rim. The cutter wheel is driven in operation so that strands of woodwool are cut by the cutters from pieces of timber located against its rim. The woodwool is directed to the interior of the wheel, through the slots, and falls onto a collector.

14 Claims, 6 Drawing Figures

Fig.1
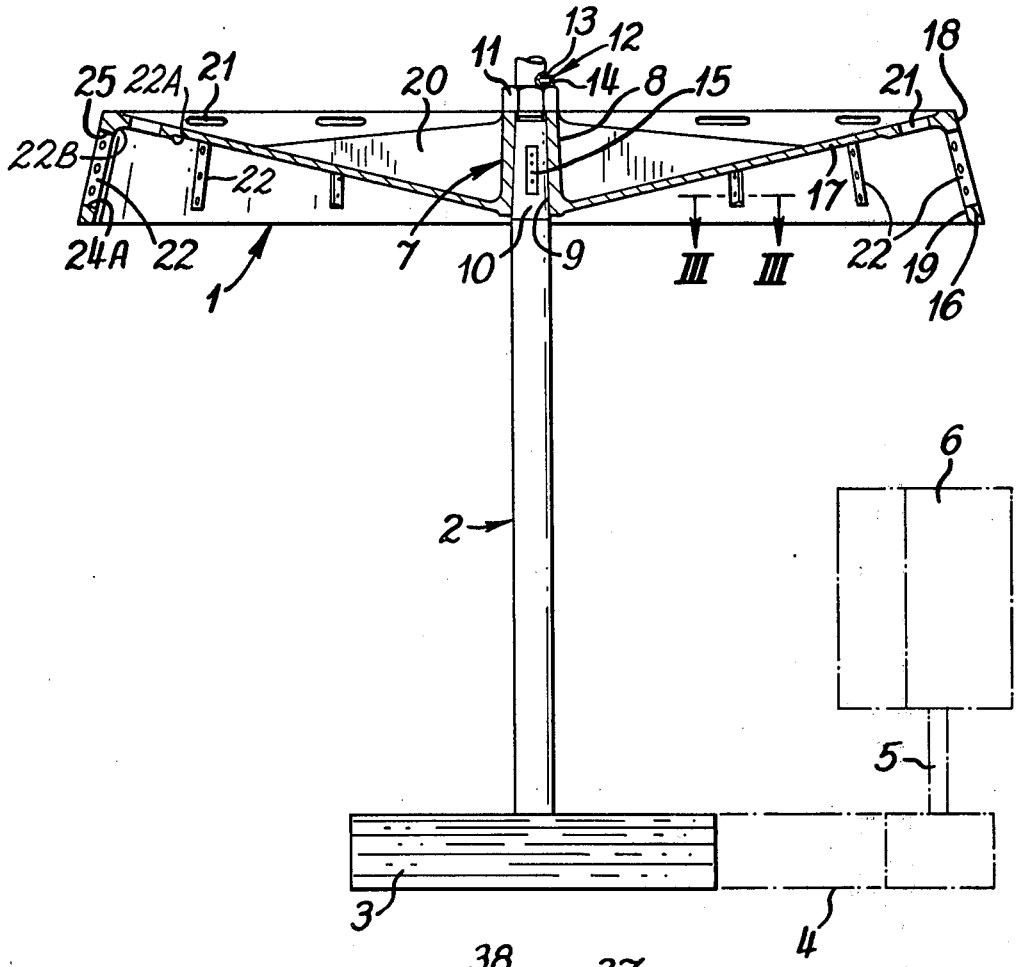
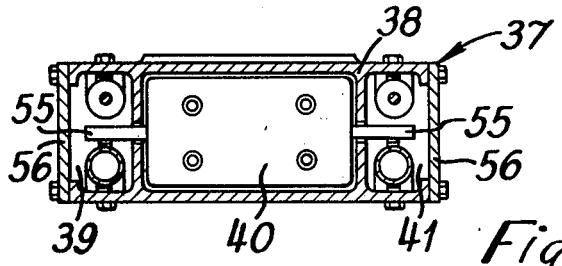
Fig.6

PRODUCTION OF WOODWOOL

This invention relates to the production of woodwool.

The standard technique for producing woodwool involves cutting the woodwool from timber stock, the cutters being carried by a reciprocating cutter block. The productivity of modern woodwool producing machines, which incorporate the conventional reciprocating cutter block, differs little from that of antique machines even though considerable effort has been made to improve that productivity.

An object of this invention is to provide an improved process for the manufacture of woodwool and to provide apparatus for carrying out that process.

According to one aspect of this invention there is provided a method of producing woodwool wherein wood is severed from timber stock by cutting means which pass the timber stock whilst being rotated about a circular path, the timber stock being supported and located relative to the cutting means such that the general direction in which its grain runs is substantially parallel to a tangent to the circular path so that wood severed by the or each cutting edge of the cutting means during each pass of that cutting edge across a piece of timber stock is severed in a continuous strip form, the cutting means comprising at least one pair of first and second cutting elements which are rotated in sequence about the circular path, one of said first and second cutting elements of the or each pair comprising discrete cutting edges which are spaced from one another across the circular path, the discrete cutting edges coacting with the wood that is severed in a continuous strip form from a piece of timber during each pass of the cutting means so that the wood so severed is separated into elongate strands of woodwool.

According to another aspect of this invention there is provided apparatus for producing woodwool comprising a rotary cutter wheel, support means which supports the cutter wheel for rotation about its axis, cutting means carried by the cutter wheel so as to be rotated about a circular path by rotation of the cutter wheel about its axis, supporting and locating means for supporting timber stock relative to the cutter wheel such that the general direction in which the grain of the timber stock runs is substantially parallel to a tangent to the circular path so that wood severed by a cutting edge of the cutting means during a pass of that cutting edge across a piece of timber stock so supported and located is severed in a continuous strip form, the cutting means comprising at least one pair of first and second cutting elements which are spaced apart circumferentially, one of said first and second cutting elements of the or each pair comprising discrete cutting edges which are spaced from one another across the circular path, the discrete cutting edges being adapted to coact with wood which is severed from a piece of timber stock which is supported and located relative to the cutter wheel by the supporting and locating means in use of the apparatus so that the wood so severed is separated into elongate strands of woodwool.

An embodiment of this invention will be described now by way of example and with reference to the accompanying drawings in which:

FIG. 1 shows an assembly of a cutting wheel, drive shaft and drive motor, the cutting wheel being shown in section with the cutting blade assemblies removed, the section being taken along a radial plane of the wheel;

FIG. 6 is a section through the feed magazine shown in FIG. 5, the section being taken along the line VI—VI in FIG. 5.

Figure 2:
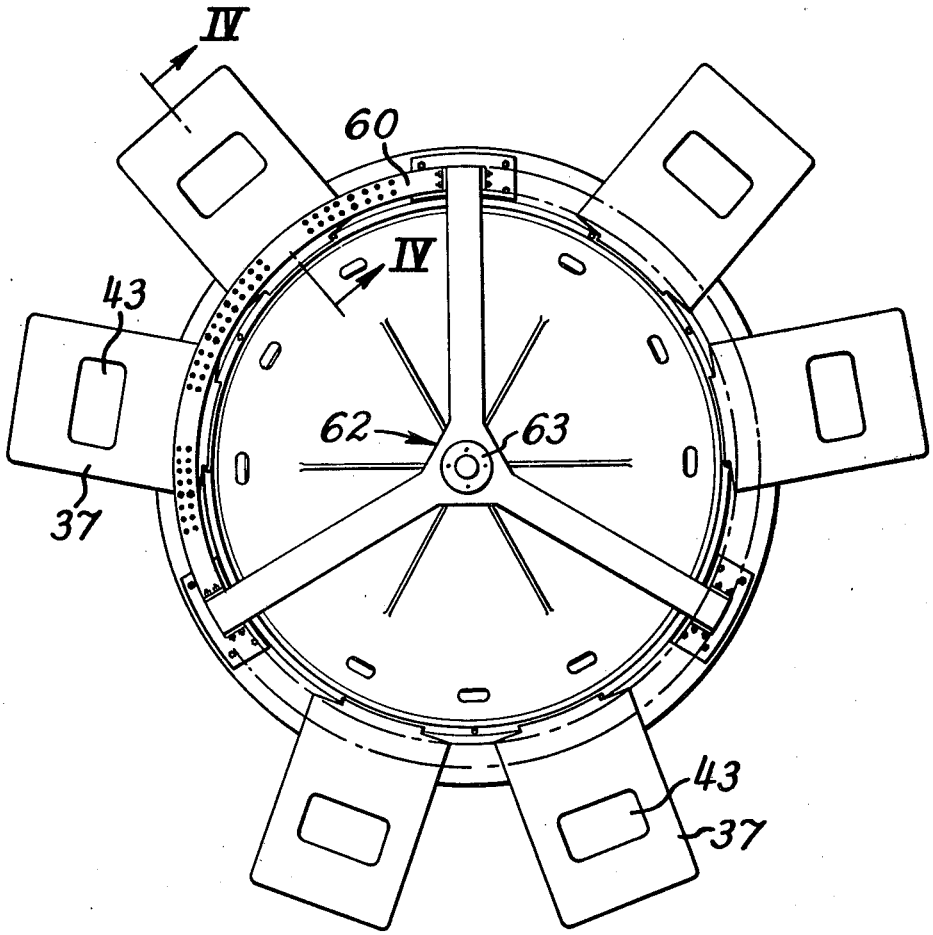
FIG. 2 is a plan view of the cutting wheel and feed magazines.
Figure 3:
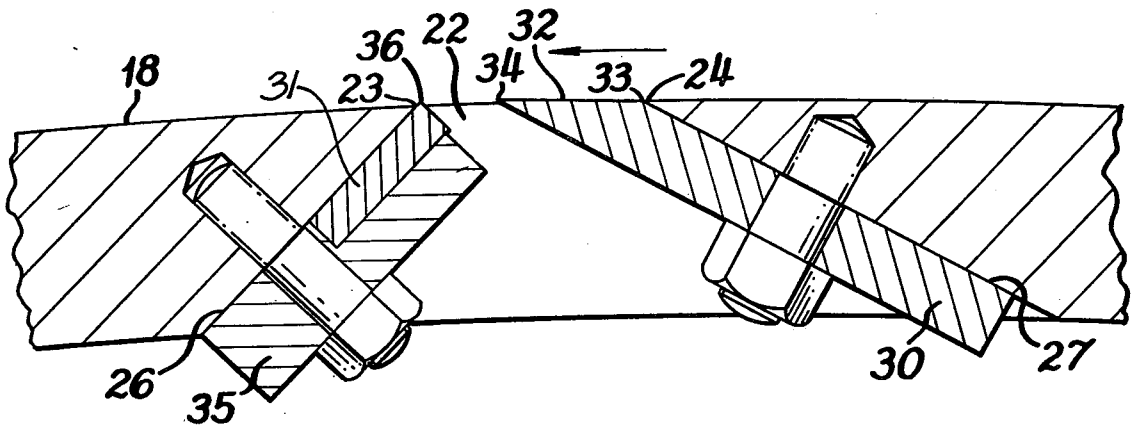
FIG. 3 is an enlarged sectional scrap view of the cutting wheel shown in FIG. 1 and shows a cutting blade assembly mounted on the cutting wheel, the section being taken along the line III—III in FIG. 1.

Referring to the drawings, apparatus for producing woodwool comprises a rotary cutting wheel 1 which is mounted on a shaft 2 for rotation therewith. The cutting wheel 1 is mounted at one end of the shaft 2. Hereafter, the terms outer and inner, and the like meaning words, are used with reference to cutting wheel 1. These words indicate locations and measurements with respect to the radius of the wheel 1. A belt pulley 3 is mounted on the shaft 2 at the other end of it. The belt pulley 3 is connected by a drive belt 4 to the drive shaft 5 of an electro motor 6. The apparatus is mounted on the ground and orientated so that the cutting wheel is rotatable in a plane which is parallel to the surface of the ground. The shaft 2 extends downwardly from the cutting wheel 1, and the electro motor 6 and the belt pulley 3 are situated below the cutting wheel 1.

The cutting wheel 1 has an integral hub 7 which has a frusto conical outer surface 8 and a frusto conical bore 9 in which a tapered portion 10 of the shaft 2 is received. The frusto conical outer surface of the hub 7 has its smaller diameter end adjacent to the smaller diameter end of the bore 9 defined in the hub 7. A cylindrical end portion of the shaft 2 projects from the smaller diameter end of the frusto conical bore 9 formed in the hub 7. The cylindrical end portion of the shaft 2 has a threaded portion and another portion which has a polished outer surface. The threaded portion is nearer the hub 7 than is the polished portion. The cutting wheel 1 is secured to the shaft 2 by a locking nut 11 which is engaged with the threaded portion of the cylindrical end portion of the shaft 2. The locking nut 11 is held in position by a locking device 12 which is positioned above the nut 11. The locking device 12 comprises a component 13 which abuts an upper surface of the nut 11 and which is secured to the cylindrical end portion of the shaft 2 by a locking pin 14.

A key 15 which is rectangular in cross-section is secured by pins to the tapered portion 10 of the shaft 2 and is engaged in a corresponding key way formed in the wall of the frusto conical bore 9 extending through the hub 7, so that the cutting wheel 1 is locked against angular movement relative the shaft 2.

The cutting wheel 1 includes an annular rim 16 which is connected by an annular frusto-conical centre piece 17 to the hub 7. The rim 16 has an outer face 18 which is frusto-conical and an inner face 19 which is geometrically similar to the outer face of the rim. The frusto-conical centre piece 17 is joined at its greater diameter end to the rim 16 at the smaller diameter end of it and is shaped so that the smaller diameter end of the centre piece 17 is between the smaller diameter end and the greater diameter end of the rim 16. The centre piece 17 is joined at its smaller diameter end to the hub 7 at the greater diameter end of it. The hub 7 projects upwardly from the centre piece 17. An angle of 90° is defined between each generator of the rim 16 and a respective one of the generators of the frusto-conical centre piece 17. Six triangular webs 20 which extend radially and are spaced equiangularly from one another join the outer frusto-conical surface 8 of the hub 7 to the inner surface of the centre piece 17. Twelve oval hand holes 21 which are spaced equiangularly from one another are defined in a thickened portion (see FIG. 1) of the centre piece 17 along its periphery at the greater diameter end of the centre piece 17. FIG. 1 shows that the step between the outer thickened portion of the centre piece 17 and the remainder, or inner thinner portion of the centre piece 17 comprises a concavely curved surface 22A which is formed in the underside of the centre piece 17 and is located adjacent the inner edges of the holes 21. Twelve slots 22 are defined in the rim 16 around its circumference. The slots 22 are spaced equiangularly from one another and each slot defined in the rim 16 is disposed immediately below a respective one of the hand holes 21 defined in the centre piece 17. FIG. 1 shows that the corner that is formed at the junction between the inner face 19 of the rim 16 and the underneath face of the centre piece 17, between a hand hole 21 and the adjacent slot 22, is formed by a concavely curved surface 22B which extends substantially from the outer edges of the hand hole 21 to the upper edge of the adjacent respective slot 22 that is disposed outwardly with respect to the respective hand hole 21. Each slot 22 has a pair of opposed longitudinal edges 23 and 24, one of which defines a leading edge 23 and the other a trailing edge 24 with regard to the sense of rotation of the wheel 1. Each of the leading and trailing edges 23 and 24 of the respective slot 22 is adjacent to the outer face 18 of the rim 16. The periphery of each slot 22 comprises a bottom face 24A and a top face 25 which are parallel to one another and a pair of lateral faces 26 and 27 which are inclined to one another so that each slot 22 widens gradually towards the rotary axis of the cutting wheel 1. One of the lateral faces 26 and 27 of each slot 22 which includes the leading edge 23 of that slot and which will be hereinafter referred to as leading face 26 lies in a plane which is inclined at an angle 45° to a radially disposed plane containing the rotary axis of the wheel 1 and extending between the leading and trailing edges 23 and 24 of that slot. The other lateral face which includes the trailing edge 24 of that slot and which will be hereinafter referred to as trailing face 27 is inclined at an angle of 60° to that radially disposed plane.

A cutting blade assembly 28 which comprises cutting means for stripping strands of woodwool from logs of timber 29 is mounted in each slot 22 defined in the frusto-conical rim 16 of the cutting wheel 1. Each blade assembly 28 comprises a rectangular planing blade 30 for shaving off strands of woodwool and an array of interspaced rectangular scoring blades 31 for making parallel cuts into the surface of the logs 29. Each planing blade 30 is secured removably by pins and co-operating nuts to a respective one of the trailing faces 27 of the slots 22 defined in the rim 16. Each planing blade 30 lies in a plane which is parallel to the plane of the trailing face 27 to which that blade 30 is secured. Each planing blade 30 has a cutting face 32 which is adjacent to the outer face 18 of the rim 16. The cutting face 32 of each planing blade 30 has a trailing edge 33 which is level with the trailing edge 24 of the slot 22 in which that blade 29 is mounted and a leading edge 34 or cutting edge 34 which is spaced outwardly from the outer face 18 of the rim 16. Each leading edge 34 of the respective cutting face 32 of each planing blade 30 extends along a line which is parallel to a respective one of the generators of the rim 16 of the wheel 1. Each array of scoring blades 31 is embedded in a respective retaining plate 35 which is secured removably by pins and co-operating nuts to the leading face 26 of the respective slot 22 so that each scoring blade 31 of the respective array of scoring blades 31 is clamped onto the leading face 26 of the respective slot 22. Each scoring blade 31 extends along a line which is parallel to the respective leading face 26 onto which it is clamped. A corner 36 of each scoring blade 31 projects from the outer face 18 of the rim 16 of the wheel 1. The outermost end of each corner 36 projecting from the outer face 18 of the rim 16 is spaced from the outer face 18 of the rim 16 by a distance corresponding to the thickness of the strand of woodwool to be shaved off by the respective planing blade. Each planing blade 30 and the respective array of scoring blades 31 are spaced from one another circumferentially so that a gap is formed between them. The scoring blades 31 of each array of scoring blades 31 are spaced from one another by a distance corresponding to the width of the strands of woodwool that are to be severed in continuous strip form from the logs of timber by the planing blades 30. The cutting edge 34 of each planing blade 30 is spaced from the outer face 18 of the rim 16 by a distance corresponding to the thickness of the strand of woodwool to be shaved off.

Six feed magazines 37 for feeding the logs of timber 29 onto the radially outer face 18 of the rim 16 of the cutting wheel 1 are arranged around the circumference of the rim 16 of the wheel 1, are spaced angularly from one another and are of identical construction. Each feed magazine 37 includes a housing 38 which is divided into three box-sectioned compartments 39, 40 and 41 which are arranged side by side. Each compartment 39, 40 and 41 extends from an outer end of the respective housing 38 to the inner end of that housing 38, the inner end being adjacent to the outer face 18 of the rim 16 of the cutting wheel 1. One of the three compartments 39, 40 and 41 of each feed magazine 37 which is disposed between the other two compartments of that magazine and which will be hereinafter referred to as the centre compartment 40 is designed to accommodate the logs of timber 29 and a pusher plate 42 for pushing the logs of timber 29 towards the radially outer face 18 of the rim 16 of the wheel 1. The other two compartments 39 and 41 flanking the centre compartment 40 of the respective feed magazine 37 will be hereinafter referred to as the side compartments 39 and 41 and are designed to accommodate the drive mechanism of the pusher plate 42 disposed in the centre compartment 40 of that magazine 37. Each centre compartment 40 has a rectangular aperture 43 defined in an upper wall of that compartment 40. The aperture 43 is nearer to the outer end of the respective housing 38 than to the radially inner end of that housing. In use of the apparatus each feed magazine is loaded by dropping the logs of timber 29 through the respective aperture 43 of the centre compartment 40.

Figure 4:
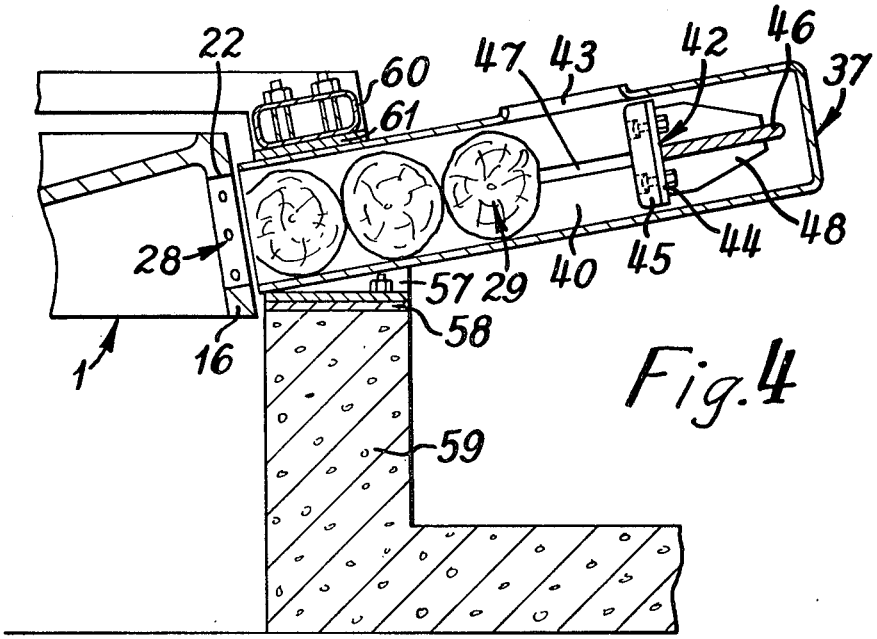
FIG. 4 is a sectional view of a feed magazine and the cutting wheel which is shown partially, the section being taken along the line IV—IV in FIG. 2.

Each pusher plate 42 of the respective feed magazine 37 is operable to reciprocate between a retracted position and an advanced position. FIG. 4 shows the pusher plae 42 in its retracted position in which it is located in a space defined between the aperture 43 and the outer end of the respective housing 38. Each centre compartment 40 of the respective housing 38 is open at an end which is adjacent to the outer face 18 of the rim 16 of the wheel 1 so as to define an aperture through which, in use of the apparatus, the logs of timber 29 are pushed by the action of the pusher plate 42.

Each pusher plate 42 comprises a rectangular pusher plate 44 which is made of steel and extends transversely to a longitudinal axis of the centre compartment 40 in which that pusher plate 42 is located. A rectangular timber plate 45 is in face-to-face contact with that side of the steel plate 44 which faces the inner end of the housing 38. The timber plate 45 is secured by bolts to the steel plate 44. A sliding plate is fixed to the other side of the steel plate 44. The sliding plate 46 extends perpendicularly to the steel plate 44 and lies in a plane which is parallel to a top and bottom wall of the centre compartment 40. The sliding plate 46 has a pair of arms 55 each of which is engaged slidably in a respective one of a pair of longitudinal slots 47 each being defined in a respective one of a pair of parallel side walls separating the centre compartment 40 from the adjacent side compartments 39 and 41. Each longitudinal slot 47 extends parallel to the longitudinal axis of the centre compartment 40. The interengagement of each arm 55 of the sliding plate 46 and the respective one of the longitudinal slots 47 ensures that the pusher plate 42 is guided for rectilinear movement along a path which is parallel to the longitudinal axis of the centre compartment 40. A pair of webs 48 is connected to the steel plate 44 and the sliding plate 46. One web 48 of the pair of webs is disposed at one side of the sliding plate 46 and the other web 48 is arranged at the other side of the sliding plate 46. Both webs 48 lie in a common plane which is perpendicular to the plane of the sliding plate 46 and to the plane of the steel plate 44. Each web 48 is connected to that side of the steel plate 44 which faces the radially outer end of the housing 38.

Figure 5:
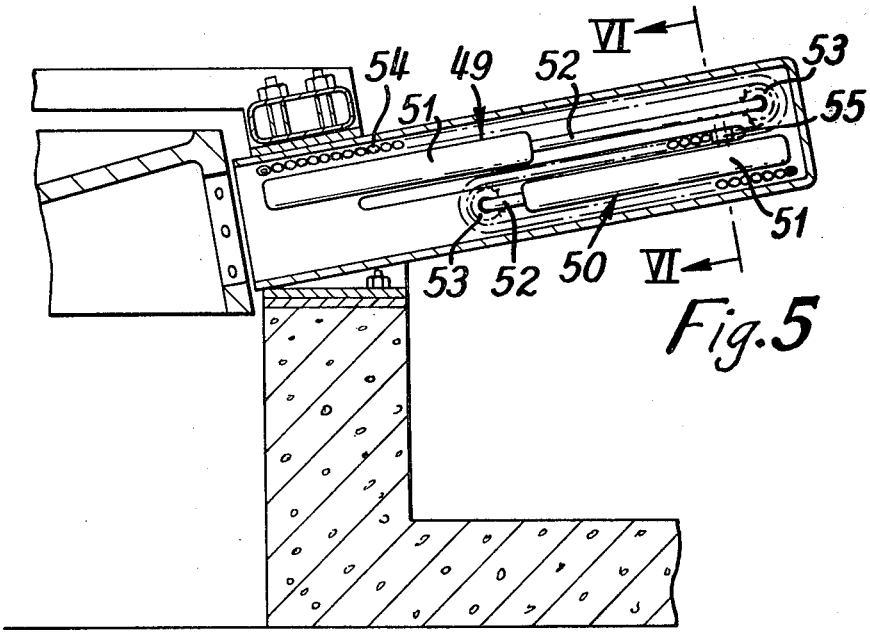
FIG. 5 is an elevational view of a feed magazine and the cutting wheel which is shown partially, the feed magazine being shown with one of its side plates removed.

Each drive mechanism of the respective pusher plate 42 comprises two assemblies of identical construction. Each drive assembly is accommodated in a respective one of the two side compartments 39 and 41 of the respective feed magazine 37. Each drive assembly comprises a pair of low pressure hydraulic rams 49 and 50. Each ram 49 and 50 includes a housing 51 and a shaft 52 which projects from the housing 51 and is movable axially relative to the housing 51. Each shaft 52 of the respective ram 49 or 50 carries a rotary chain wheel 53 at its outer end. One ram of the pair of rams 49 and 50 is mounted on an upper wall of the respective side compartment and will be hereinafter referred to as the upper ram 49. The other ram is mounted on a lower wall of that side compartment and will be hereinafter referred to as the lower ram 50. The upper ram 49 has its housing 51 nearer to the inner end of the housing 38 of the feed magazine 37 and its chain wheel 53 nearer to the outer end of the housing of the feed magazine. The rams 49 and 50 co-operate with a heavy duty roller chain 54 which is accommodated in the respective side compartment. The chain 54 is fixed at one end to the upper wall of the side compartment at a position thereon which is adjacent to the radially inner end of the housing 38 of the feed magazine 37 and is fixed at its other end to the lower wall of the respective side compartment at a position thereon which is adjacent to the outer end of the feed magazine 37. The chain extends outwardly from its end which is nearer to the inner end of the housing 38 of the feed magazine 37 to the chain wheel 53 of the upper ram 49, is engaged with that chain wheel 53 and extends inwardly from that chain wheel 53 of the lower ram 50. The chain 54 is engaged with the chain wheel 53 of the lower ram 50 and extends outwardly from the chain wheel 53 of the lower ram 50 to its end which is nearer to the outer end of the housing 38 of the feed magazine 37. Each arm 55 of the sliding plate 46 of the respective pusher plate 42 projects into a respective one of the side compartments 39 and 41 and is engaged with the chain 54 at a point thereon which is between the two chain wheels 53. One ram of each pair of rams 49 and 50 mounted in the respective side compartment is always retracted when the other ram of that pair of rams is extended. In FIG. 5 the upper ram 49 is extended and the lower ram 50 is retracted.

Both shafts 52 of the rams 49 and 50 are movable simultaneously in the same direction so that when the apparatus is in use the upper ram 49 retracts while the lower ram 50 extends and vice versa. It will be appreciated that both pairs of rams 49 and 50 accommodated in a respective one of the feed magazines 37 are actuated simultaneously. Each feed magazine 37 has a respective control unit for actuating the respective pairs of rams 49 and 50 located in that feed magazine 37.

Each side compartment 39 and 41 of the respective housing 38 of the feed magazine 37 is closed by a respective side plate 56 which is secured by bolts to the upper and lower walls of that side compartment. Each feed magazine 37 is inclined to a plane of rotation of the cutting wheel 1 so that the longitudinal axis of each centre compartment 40 is perpendicular to a respective one of the generators of the rim 16 of the cutting wheel 1. Each feed magazine 37 has a respective leg 57 by which that feed magazine 37 is mounted removably on an annular base plate 58 which surrounds the rim 16 of the wheel 1 concentrically and which is disposed below the magazines 37.

The base plate 58 is mounted on a cylindrical concrete structure 59. The cutting wheel 1 and the cylindrical concrete structure 59 are aligned axially with one another and the greater diameter end of the rim 16 is level with an upper end of the cylindrical concrete structure 59. The upper end of the cylindrical concrete structure 59 is defined by an annular flat surface upon which the base plate 58 is placed. The concrete structure 59 defines a cylindrical space which is below the cutting wheel 1. The drive shaft 2, the belt pulley 3 and the electro motor are situated in the cylinder space defined by the concrete structure. A frusto-conical woodwool collector which is not shown is disposed coaxially in the cylinder space defined by the concrete structure. The collector is open at its smaller diameter end to define an aperture through which in use of the apparatus woodwool stripped from the logs of timber 29 drops. A conveyor belt which is not shown is disposed below the frusto-conical collector so that in use of the apparatus woodwool that drops through the aperture of the collector falls onto the conveyor belt. The conveyor belt is arranged to convey woodwool to a baling machine which is not shown. Each pair of juxtaposed feed magazines 37 is mounted removably on a respective one of three interspaced arcuate box sectioned segments 60 which are arranged in a circle surrounding the cutting wheel 1 concentrically. The box sectioned segments 60 are disposed above the feed magazines 37. An arcuate spacer plate 61 is positioned between each segment 60 and the respective pair of juxtaposed feed magazines 37. Each segment 60 is secured by bolts at its end to a bearing spider 62 which has three radial arms which are spaced angularly from one another. The bearing spider 62 which is disposed above the cutting wheel 1 and which is axially aligned with it includes an integral hub 63 from which the three arms of the spider project radially. The hub 63 has a central bore in which the polished cylindrical end portion of the drive shaft 2 is received so as to locate the drive shaft 2 in the radial direction relative to the rotary axis of the wheel 1. Each arm of the bearing spider 62 is mounted at its outer end on the flat surface of the concrete structure 59. Each box-sectioned segment 60 and the respective spacer plate 61 extends between a respective pair of the arms of spider 62. Each segment is mounted at its ends on the pair of arms of the spider between which it extends. Each feed magazine 37 is secured to the respective segment 60 and the respective base plate 58. Each segment 60 and the base plate 58 has a plurality of holes to provide a plurality of bolting-on positions for the feed magazines 37 so that each magazine can be moved around the periphery of the cutting wheel from its position shown in FIG. 2 to another position on the respective box sectioned segment 62.

It will be appreciated that although six feed magazines are shown in FIG. 2, the number could be more or less.

It is to be understood that the feed magazines shown in FIG. 2 are spaced angularly from one another so that in use of the apparatus some of the cutting blade assemblies strike the timber at exactly the same time. However, this arrangement may lead to a poor utilisation of the available power so that an alternative arrangement may be preferred in which the magazines are so placed that some of the blade assemblies are always engaged with the timber thus obtaining smoother power absorption.

In use of the apparatus, the feed magazines are loaded with logs of timber 29. The logs of timber are introduced into the respective centre compartment of the magazines through the aperture 43 of that magazine 37. During loading of each feed magazine the respective pusher plate is retracted and the hydraulic rams 49 and 50 are in the position shown in FIG. 5. The logs of timber fed into the respective magazine 37 are located side by side and orientated so that each log extends transversely to the longitudinal axis of the centre compartment of the respective magazine 37. Hence, the general direction in which the grain of each log runs is substantially parallel to a tangent to the exterior of the rim 16. When the feed magazines are loaded, the electromotor is switched on. The electromotor drives the belt pulley which in turn rotates the shaft 2 so as to rotate the cutting wheel. Hence, the array of scoring blades 31 and the planing blades 30 that are spaced from one another circumferentially about the wheel 1 are rotated in sequence through a circular pathway. At the same time the hydraulic rams 49 and 50 are actuated. The upper ram 49 is retracted while the lower ram 50 is extended whereby the respective pusher plate is pushed radially inwardly relative to the cutting wheel by the engagement of the arms 55 with the respective chains 54. The pusher plate 42 engages the log which is nearest to it so as to push that log radially inwardly. The action of the pusher plate upon the log which is nearest to it is transmitted to the other logs located in the respective centre compartments so that the log which is adjacent to the cutting wheel 1 is urged onto the radially outer face of the rim of the cutting wheel.

Each cutting blade assembly strikes the logs that are urged tangentially onto the outer face of the rim of the wheel 1. The cutting wheel rotates anti-clockwise so that each array of scoring blades strikes the respective log of timber before the respective planing blade engages that log.

The scoring blades make parallel cuts into the surface of the respective log. The depth of each scoring blade cut corresponds to the thickness of the strand of wood which is then shaved off the log by the respective planing blade. In this way, the cutting action of the scoring blades is such that the wood that is shaved off the log by the respective planing blades is formed into separate elongate strands of woodwool, when severed. The strands of wood are directed inwardly through the gap defined between each planing blade and the respective array of scoring blades and drop into the conical collector from which they are conveyed by the conveyor belt to the baling machine. When all the logs in each magazine 37 have been used up, the magazines are reloaded. To this end each pusher plate is retracted by the action of the lower ram 50 and the upper ram 49 which are retracted and extended respectively.

In a modification of the apparatus, each magazine includes a single hydraulic feed ram instead of the assembly of four rams 49 and 50 and the pusher plate 42 shown in FIG. 6. In another modification of the apparatus each feed magazine includes a lever mechanism for pushing the logs of timber onto the outer face of the rim.

The rams or lever mechanisms of the feed magazines may be controlled automatically or manually.

The setting of the scoring blades and the planing blades may be varied to provide strands of woodwool of variable widths and thickness. Each array of scoring blades and the respective planing blade may be mounted in a cutter box which is secured removably to the rim of the wheel. There may be more than one set of cutter boxes. The setting of the scoring blades and planing blades of one set of cutter boxes may be different from the setting of the scoring blades and planing blades of the other set or sets of cutter boxes so that strands of wood which vary in width and thickness can be produced.

The spacing of the blade assemblies may be varied. There may be more or less than twelve blade assemblies mounted on the cutting wheel.

Any convenient arrangement of cutting means may be fitted to the rotary cutter wheel in place of each cutting assembly which is described above as comprising an array of scoring blades and a planing blade. One such alternative arrangement comprises a serrated cutter in place of each array of scoring blades, the serrated cutter being adapted to plane a series of grooves in the timber stock and thereby to remove strands of woodwood from the timber stock, the remaining raised portions of the timber stock being removed by the following cutter of the respective cutter assembly which may be a single planing blade or a suitable serrated cutter.

I claim:

1. A method of producing woodwool, comprising:

arranging and supporting timber stock at an orientation such that the general direction in which the grain of the stock runs is substantially parallel to a tangent to a circular pathway, wherein the circular pathway is defined around a vertical axis;

moving a cutting edge around side circular pathway for causing the cutting edge to sever strands of woodwool as the cutting edge passes the timber stock;

orienting the cutting edge, as it is moved, such that the upper end of the cutting edge is closer to the axis of said circular pathway than the lower end of the cutting edge, and causing the cutting edge to sever strands of woodwool from a side of the timber stock that is parallel to the orientation of the cutting edge.

2. Apparatus for producing woodwool comprising:

woodwool cutting means having cutting edges; support means for supporting the cutting means for rotation about a vertical axis so that the cutting edges trace a circular path about the vertical axis when the cutting means are rotated about the vertical axis, the cutting edges each having an upper cutting edge portion and a lower cutting edge portion, the circular path traced by the cutting edges having an upper circular edge, which is traced by the upper cutting edge portions, and a lower circular edge which is traced by the lower cutting edge portions;

means for rotating the cutting means about the vertical axis;

the cutting means support means supporting the cutting means such that each upper cutting edge portion is nearer to the vertical axis than is the respective lower cutting edge portion so that the radius of the upper circular edge of the circular path is less than the radius of the lower circular edge of the circular path;

supporting and locating means for supporting timber stock at a location adjacent to and radially outside of the circular path and substantially parallel to a tangent to the circular path, whereby strands of woodwool are severed from timber stock so supported and located by the interaction of the cutting edges of the cutting means with that timber stock.

3. Apparatus according to claim 2, wherein the cutting edges are all shaped and oriented such that the circular path that they trace tapers upwardly toward the vertical axis.

4. Apparatus according to claim 3, wherein the cutting means support means comprises a wheel which has a depending peripheral rim with an upper and a lower portion, and the rim tapering upwardly from the lower portion and having spaced apart apertures in it, the cutting means being located within the apertures in the rim, the rim further having an outer surface opposed to the timber stock and an opposite, inwardly facing inner surface.

5. Apparatus according to claim 4, wherein the inner surface of the rim is correspondingly tapered to the outer surface of the rim.

6. Apparatus according to claim 4, wherein the wheel includes a central hub near the axis and an annular centre piece for joining the hub and the rim, the annular centre piece being joined to the upper portion of the rim, and the underside of the annular centre piece tapering downwardly moving toward the hub from the upper portion of the rim.

7. Apparatus according to claim 6, wherein there is a concavely curved surface formed at the junction of the inner surface of the rim and the underside of the annular centre piece.

8. Apparatus according to claim 7, wherein the inner surface of the rim is correspondingly tapered to the outer surface of the rim.

9. Apparatus according to claim 6, wherein the underside of the annular centre piece is stepped near its junction with the inner surface of the rim, the surface of the step being a concavely curved surface.

10. Apparatus according to claim 9, wherein there is a concavely curved surface formed at the junction of the inner surface of the rim and the underside of the annular centre piece.

11. Apparatus according to claim 10, wherein the inner surface of the rim is correspondingly tapered to the outer surface of the rim.

12. Apparatus according to claim 4, wherein the cutting means support means further comprises a vertical shaft which carries the wheel and which depends a substantial distance from the wheel into a well below the wheel.

13. Apparatus according to claim 2, wherein said supporting and locating means comprise at least one magazine which is adapted to feed pieces of timber stock radially inwardly to the location adjacent the circular path, each magazine comprising a pusher plate and driving means for urging the pusher plate towards the circular path whereby the pusher plate urges pieces of timber towards the circular path, the driving means comprising a pair of fluid pressure operable, telescoping rams which are mounted with their longitudinal axes parallel and being extensible in opposite directions, each ram having a body and a respective extensible, relatively movable ram rod, having an outer end, an inextensible flexible elongate member which is anchored at its ends and which extends around each of the ram rod ends, connecting means for connecting the pusher plate to the portion of the elongate member between the ram rod outer ends, whereby the pusher plate is moved in one direction by extension of one of the rams and contraction of the other ram and is moved in the opposite direction by contraction of the one ram and extension of the other ram.

14. Apparatus according to claim 13, wherein each magazine comprises a housing for accommodating pieces of timber, the housing having two juxtaposed compartments with a common wall, the pusher plate being located and guided for radial movement relative to the circular path within one of the compartments and the pair of telescopic rams being housed in the other compartment, a common wall between the two compartments with a slot in the wall through which the connecting means extend, a first aperture in the one compartment through which pieces of timber stock are inserted into the one compartment and a second aperture in the one compartment through which the pieces of timber stock are discharged by the pusher plate, the second aperture being defined at an end of the generally radially extending path of the pusher plate and which is adjacent to the circular path.

* * * * *